United States Patent [19]

Cazzaro et al.

[11] 4,224,210

[45] Sep. 23, 1980

[54] FIBER FROM ACRYLONITRILE COPOLYMERS HAVING REDUCED INFLAMMABILITY, COMPOSITIONS AND PROCESSES FOR MANUFACTURING THE SAME

[75] Inventors: Giorgio Cazzaro, Saronno; Giancarlo Matera, Monza; Domenico Malgeri, Magente; Antonino Cavallaro, Milan, all of Italy

[73] Assignee: SNIA Viscosa Societa' Nazionale Industria Applicazioni Viscosa S.p.A., Italy

[21] Appl. No.: 953,971

[22] Filed: Oct. 19, 1978

[30] Foreign Application Priority Data

Oct. 19, 1977 [IT] Italy ..... 28759 A/77

[51] Int. Cl.[2] ..... C08K 5/20; C08L 33/20

[52] U.S. Cl. ..... 260/32.6 N; 260/29.6 RW; 260/30.8 DS; 525/291; 525/274; 264/182

[58] Field of Search ..... 260/881, 32.6 N; 525/291, 274

[56] References Cited

U.S. PATENT DOCUMENTS

| | | | |
|---|---|---|---|
| 3,256,252 | 6/1966 | Kruckenberg et al. | 260/79.3 |
| 4,101,621 | 7/1978 | Yamamoto et al. | 260/881 |

*Primary Examiner*—Carman J. Seccuro

*Attorney, Agent, or Firm*—Wenderoth, Lind & Ponack

[57] ABSTRACT

Textile fibers having reduced inflammability and high luster, constituted by copolymers of acrylonitrile, vinylidene chloride and a significantly homopolymerizable sulphonic comonomer are described. Significantly homopolymerizable comonomers are defined as monomers which homopolymerize with a conversion above 30°–40° under standard conditions set forth in the specification. A preferred class of such comonomers are the derivatives of acrylamidoalkanesulphonic acids, e.g. 2-acrylamido-2-methylpropane-sodium sulphonate. The fibers are spun from spinning dopes containing said copolymers in solution in organic solvent miscible with water and less than 4% of water. Said spinning dopes can be obtained by preparing a binary copolymer of acrylonitrile and the sulphonic monomer, in solution in the solvent, mixing the solution with a solution of acrylonitrile and vinylidene monomers in the same solvent, and subjecting the mixture to copolymerization. The copolymers finally obtained contain 50–85% of acrylonitrile, 13.5–46.5% of vinylidene chloride, and 1.5–3.5% of the sulphonic comonomer, the percentages being by weight.

9 Claims, 4 Drawing Figures

FIG. 1
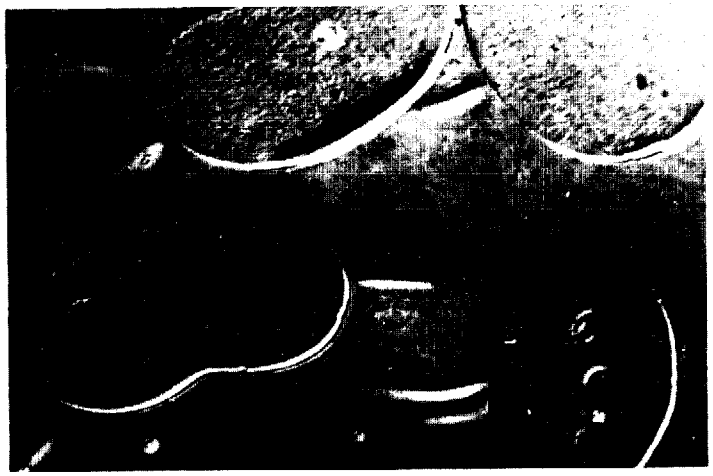
FIG. 2
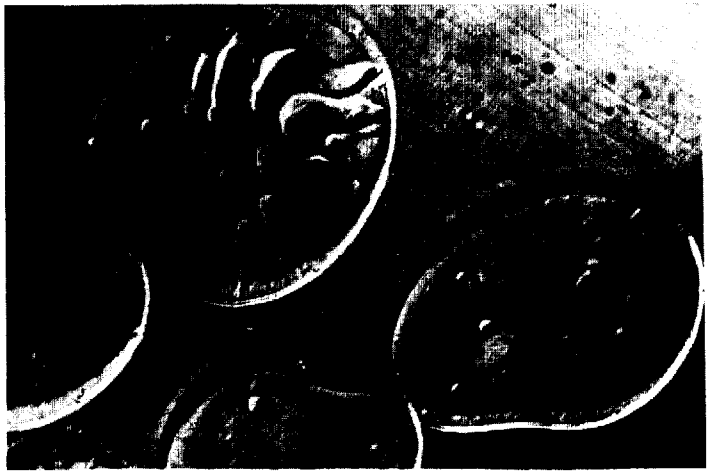
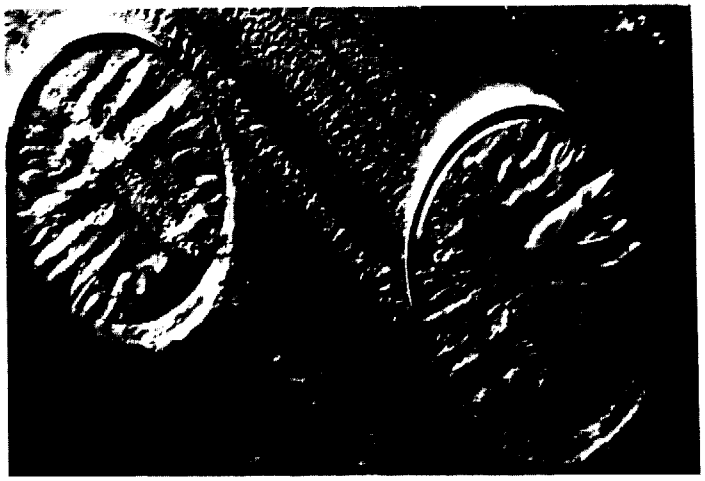
FIG. 3
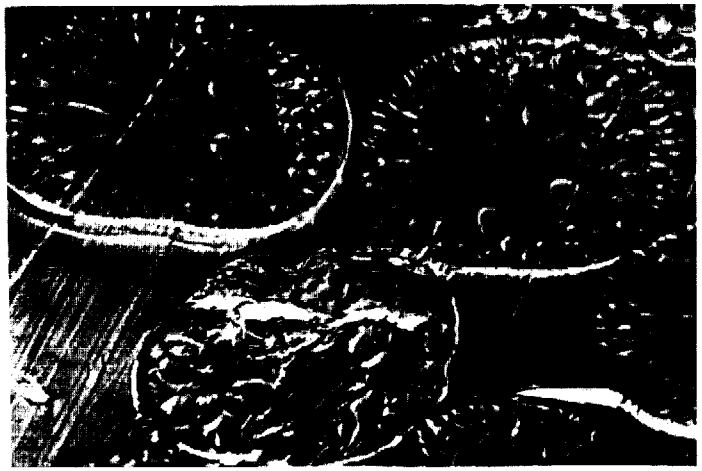
FIG. 4

FIBER FROM ACRYLONITRILE COPOLYMERS HAVING REDUCED INFLAMMABILITY, COMPOSITIONS AND PROCESSES FOR MANUFACTURING THE SAME

BACKGROUND OF THE INVENTION (a) The Field of the Invention

The present invention relates to modacrylic fibers, viz, to fibers constituted by copolymers of acrylonitrile with other comonomers copolymerizable therewith, and wherein acrylonitrile is present in amounts from 50% to 85% inclusive, which possess reduced inflammability and high luster, and to compositions and processes for their manufacture.

The modacrylic fibers to which the invention refers are prepared by copolymerization of acrylonitrile with the other monomers in an organic spinning solvent miscible with water, particularly dimethylformamide (DMF), but possibly other solvents as well, such as dimethylacetamide, dimethylsulphoxide, etc., to form a viscous spinning dope, and subsequent extrusion of the spinning dope into a coagulation bath constituted by water mixed with the spinning solvent.

(b) The Prior Art

It is known to make modacrylic fibers having reduced inflammability by copolimerizing acrylonitrile with vinylidene chloride, and in order to confer to the copolymer the desired dyeing properties, a further comonomer containing at least one sulphonic group is used, the whole according to suitable weight ratios. According to the known ternary copolymerization technique, the sulphonic groups containing comonomer is normally constituted by the sodium salt of allyl- or methallyl- or vinyl- or styrene-sulphonic acid.

It is also known to prepare a copolymer of the said type or more exactly a mixture of copolymers, instead of by direct copolymerization of the three comonomers (acrylonitrile, vinylidene chloride, sulphonated monomer) by a two-phase copolymerization process, comprising e.g. firstly the preparation of a binary acrylonitrile/sulphonated monomer copolymer, then the addition of said binary copolymer to a solution of acrylonitrile and vinylidene monomers in DMF or other solvent, and the copolymerization of the two latter monomers in the presence of the preformed copolymer; the resulting viscous solution being subsequently spun, e.g., in the wet in an aqueous coagulating bath.

In all such process the problem of obtaining a glossy or lustrous fiber arises. To this end it has been proposed (DOS No. 2624081) to add, in a two-phase polymerization process as hereinbefore described, substantial amounts of water (up to 10%—anyway not less than 4–5%) to the spinning dope.

SUMMARY OF THE INVENTION

Now the Applicant has surprisingly found that if in a copolymerization process for the preparation of copolymers and copolymer mixtures, of the type described, an unsaturated monomer containing at least a sulphonic group is used which will be defined as "significantly homopolymerizable"—viz. which homopolymerizes, in the presence of $2.10^{-3}$ mols per liter of AIBN (azobisisobutyronitrile), at a concentration of $2.10^{-1}$ mols per liter in DMF which contains 6 mols per liter of water, at a temperature of 67° C., with a conversion above 30–40% after 11 hours—the water content of the spinning dope can be eliminated or at least substantially reduced, and yet a lustrous fiber is still obtained. Said sulphonated monomers must be sufficiently soluble in the copolymerization mixture and in the solvent to allow carrying out a continuous copolymerization process in organic solvent in homogeneous phase. This constitutes an important progress because the addition of water involves complications in the process and increased costs, and, owing to the coagulating properties of water, it endangers the stability of the solution.

The preferred significantly homopolymerizable monomers are the derivatives (especially the alkali and ammonium salts) of the acids having the general formula:

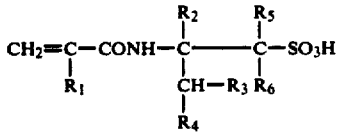

wherein $R_1$ is a hydrogen atom or a short chain alkyl radical, and $R_2,R_3,R_4,R_5,R_6$, equal to or different from one another, are each a hydrogen atom or an alkyl, cycloalkyl or aryl radical, e.g. of acrylamido-alkanesulphonic acids, among which derivatives, 2-acrylamido-2-methyl-propane-sodium sulphonate which has a homopolymerization capacity, evaluated as set forth hereinbefore, above 50% compared with 4% in the case, e.g., of sodium allylsulphonate, and other which will be mentioned. Said sulphonated monomers, further, exhibit a very high rate of utilization in the copolymerization, e.g. above 90%. "Rate of utilization" means herein the percentage of monomer which becomes a part of the copolymer molecule.

An object of the present invention is therefore textile fibers having reduced inflammability and high glossiness, constituted by copolymers of acrylonitrile, vinylidene chloride, and a significantly homopolymerizable sulphonic comonomer, containing from 50% to 85% by weight of acrylonitrile units, from 13.5% to 46.5% by weight of vinylidene chloride units, and form 1.5% to 3.5% by weight of sulphonated comonomer units, as well as the process for their preparation. A further object of the invention are the compositions of matter constituted by the spinnable viscous solutions containing the said copolymers or copolymer mixtures and containing less than 4% by weight of water, from which compositions the fiber is obtained, as well as the process for their preparation which comprises the steps of copolymerizing, in a first phase, acrylonitrile with at least one significantly homopolymerizable sulphonic monomer, in a first solution in an organic spinning solvent miscible with water, in particular DMF, adding the solution resulting from said first copolymerization phase, which contains the binary copolymer formed as well as unreacted monomers dissolved in said solvent, to a second solution of acrylonitrile and vinylidene chloride (and possibly other comonomers) in the same solvent and subjecting the resulting mixture to a second copolymerization phase.

The proportions expressed as weight percentages employed in the process are as follows.

For the first copolymerization, the overall percentage of the monomers is comprised between 25% and 35% referred to the total weight of the first solution; and the sulphonated monomer constitutes between 8% and 30% by weight of the sum of the two comonomers.

The second solution has an overall weight concentration of acrylonitrile and vinylidene chloride comprised between 40% and 50% of the total, the acrylonitrile constituting between 35% and 85% of the total of the two monomers. The mixed solution comprises between 5 and 40 parts by weight of the solution resulting from the first copolymerization and between 60 and 95 parts by weight of the second solution.

The second copolymerization phase is started immediately upon termination of the first phase and after completely mixing the solution obtained from the first copolymerization with the second solution, in the appropriate ratios.

Otherwise the polymerization technique is the known one. In particular, the catalysts used are preferably chosen among the azo derivatives, in particular azobisisobutyronitrile; the temperatures are between 50° and 70° C. for the first copolymerization phase and between 40° and 60° C. for the second; the durations are respectively comprised between 8 and 12 hours for the first phase and between 10 and 15 for the second. The exact composition of the final viscous solution which results from the second copolymerization phase and which is then used in the spinning, is not precisely known. It is likely that the solution contains both binary copolymers and ternary copolymers and graft copolymers deriving from the copolymerization of the acrylonitrile and vinylidene chloride monomers in the presence of a preformed binary copolymer. The Applicant does not wish to be limited by any interpretation of the exact structure of the spinning dope, which anyway is not relevant to the ends of the invention.

Obviously a plurality of sulphonic derivatives could be used instead of one, all belonging to the class hereinbefore defined, and what has been said with reference to the sulphonic derivative would apply to the sum of the sulphonic derivatives. Further comonomers, such as acrylic esters or other unsaturated compounds, could be present. The results obtained through the invention, and in particular the surprising progress from the viewpoint both of the characteristics of the fiber and of the utilization rate of the sulphonated comonomer in the copolymerization, with respect to what was already known and obtainable by using the sulphonated comonomers heretofore used for this type of production, and the fact that glossy yarns are obtained from dopes which are free of, or contain small amounts of water, are quite surprising.

Investigations which have been carried out suggest that significantly homopolymerizable monomers form homopolymeric segments in the copolymer chain, which other sulphonic monomers do not. Such segments are believed to facilitate the elimination of the spinning solvent from the coagulated bodies and to confer to the filaments, as a consequence, a more compact and void-free structure. While the Applicant believes that these phenomena do occur and cause or contribute to the surprising results of the invention, he does not wish to be bound to any interpretation of the mechanism by which the invention operates, and it suffices that the results thereof can be experimentally ascertained and have been proved by experience, as will appear from the following examples.

DETAILED DESCRIPTION OF PREFERRED EMBODIMENTS

In said examples the various binary and ternary copolymers according to this invention are obtained from polymerization in known type reactors equipped for this purpose, the copolymerization being effected in homogeneous phase in organic solvent; the respective fibers have been obtained as specified hereinafter, using as coagulation baths, mixtures of solvent (DMF) and water and producing a count of 3.3 dtex per filament.

Spinning conditions

(A) Spinneret

A spinneret having 175 orifices with a diameter of 65 micron has been used to obtain the desired 3.3 dtex filament count in the final fibre.

(B) Spinneret Feed

A gear micropump delivering 0.6 cc per revolution is used, its number of revolutions being controlled so as to feed to the spinneret the amount of polymeric solution, drawn from a reservoir maintained at 30°-40° C. required to produce the desired count.

(C) Coagulation

The coagulation is carried out in a trough having a length of about 1 meter, containing a bath maintained at 12°-13° C. and at a constant water content of 60% and DMF content of 40%.

(D) Collection

From the coagulation trough, the yarn is drawn by a roller/pin device at a speed of 10 mt/min.

(E) Washing

The yarn passes from the coagulation through into a series of wash tubs, fed with demineralized water kept at 50° C., in countercurrent, until the DMF content of the yarn, calculated on the dry yarn, is less than 0.5%.

(F) Drawing

From the wash tubs, the yarn is passed through a drawing tub having the same dimension as the coagulation trough, which contains demineralized water kept at 98°-100° C. where the yarn undergoes drawing to a draw ratio of 5.5, from which it is collected at a speed of 55 mt/min by means of another roller/pin device; after drawing, the yarn passes through a finishing tub where lubrificants and antistatics, known for this purpose, are applied thereto.

(G) Drying

After drawing, the yarn enters a ribbon dryer which permits the yarn freely to contract during the drying in air at 130° C., by an amount of about 20%.

The fiber thus obtained is ready to undergo the controls established for this case, viz.:

(a) The cross-section of the filament after coagulation is microphotographed (FIGS. 1-4 of the attached sheet);

(b) The dye yield of the final dry fiber is determined through the amount of dye required to obtain in the fibers according to the various examples, the same shade of color obtained in a preferred fiber, according to the present invention, assumed as the basis of the comparison, when it is dyed with a given amount of dye. As preferred comparison fiber, that of example no. 1 has been chosen, and the shade of color to be obtained in all cases is that which the said fiber assumes when dyed with 2 grams of dye per 100 grams of dry fiber.

The color chosen for this control, is a dark brown hue obtained by using a mixture of the following three dyes in the following proportions:

(1) Yellow Maxilon 3 RL=50%

(2) Red Maxilon GRL=24%

(3) Blue Maxilon GRL=26%.

The shade of color obtained, e.g. in the fiber of example 1, has been obtained by dyeing in the conventional way, until exhaustion of the dye, 5 g of fiber in 200 cc of an aqueous solution containing 0.1 g of the aforesaid dye mixture.

Therefore only the number of grams of dye used up by 100 g of the fiber under examination will be indicated under item (b) of the control data. It is obvious that the higher said number, the more opaque will be the fibre.

(c) The degree of inflammability is determined, as expressed by the LOI (Limiting Oxygen Index) value, which indicates the minimum oxygen content in the air required for igniting the product under the test conditions defined by the ASTM-D-2863-70 method. Products having a LOI equal to or greater than 26 are considered as having reduced inflammability.

(d) The dynamometric characteristics of the fibre are determined in the conventional way.

A number of illustrative and non-limitative examples are described hereinafter.

EXAMPLE No. 1

In this example the conditions are described relative to the two-phase copolymerization process, viz. the process which involves adding the end polymerization mixture resulting from the preparation of the binary acrylonitrile/sulphonated monomer copolymer, to the mixture of acrylonitrile/vinylidene chloride monomers relative to the second polymerization phase.

The sulphonated monomer is 2-acrylamido-2-methylpropane-sodium sulphonate.

The control data relative to the fiber thus obtained, which represents the most preferred embodiment of the present invention, are also set forth.

In the first phase, a binary acrylonitrile/2-acrylamido-2-methylpropane-sodium sulphonate is produced by copolymerizing at 67° C. for 11 hours, 27.20 parts by weight of acrylonitrile and 4.8 parts by weight of said sulphonated monomer in 2 parts by weight of water and 66 parts by weight of dimethylformamide in the presence of 0.027 parts by weight of azobisisobutyronitrile catalyst and 0.015 parts by weight of malic acid stabilizer. At the end of the polymerization the mixture contains 21% by weight of a copolymer composed by 85% by weight of acrylonitrile and 15% parts by weight of 2-acrylamido-2-methylpropane-sodium sulphonate.

One part by weight of the said mixture is mixed immediately, viz. without distilling the unreacted monomers, with 6.5 parts by weight of a mixture containing 26.55 parts by weight of acrylonitrile, 18.45 parts by weight of vinylidene chloride, 4 parts by weight of water and 51 parts by weight of DMF. The resulting mixture is subjected to polymerization at 52° C. for 13 hours in the presence of 0.22 parts of azobisisobutyronitrile catalyst and 0.1 parts of zinc paratoluenesulphonate color stabilizer.

At the end of the polymerization the mixture contains 19.2% of a polymer which, when analyzed in the normal way, is found to contain 61% by weight of acrylonitrile, 36% by weight of vinylidene chloride and 3% by weight of the sulphonated monomer, while the utilization rate of said sulphonated monomer is 90.62%.

The solution is distilled under a vacuum to eliminate and recover the volatile unreacted monomers and to eliminate the water and a final solution is thus obtained which contains 22.5% of polymer, and which is spun as hereinbefore indicated.

The fiber thus produced has the following control data:

a: see photo No. 1 (FIG. 1)

b=2.0 c=26% of $O_2$ d:

filament count in dtex=3.3 tenacity in g/dtex=2.6 elongation %=32 loop tenacity in g/dtex=1.3

The control data for this example, compared with those of comparison example no. 4 relative to a fiber which has the same final composition but the polymer of which has been obtained by the usual ternary copolymerization process, prove that this fiber has a much higher luster and a considerably higher dye yield. No practical difference exists as to the degree of inflammability and the dynamometric characteristics.

EXAMPLE No. 2

In this example the control data are set forth of a fiber which has the same final composition as that of example no. 1, viz. 61% by weight of acrylonitrile, 36% by weight of vinylidene chloride and 3% by weight of sulphonated derivative, but which has been obtained by using an end polymerization mixture of the first phase, through which a binary acrylonitrile/sulphonated derivative is produced, which contains a considerably higher percentage (25%) of 2-acrylamido-2-methylpropane-sodium sulphonate with respect to that of example no. 1.

Said copolymer is obtained by polymerizing at 67° C. for 11 hours, 22.5 parts by weight of acrylonitrile and 7.5 parts by weight of 2-acrylamido-2-methylpropane-sodium sulphonate in 4 parts by weight of water and 66 parts by weight of DMF in the presence of 0.027 parts by weight of azobisisobutyronitrile catalyst and 0.015 parts by weight of malic acid stabilizer.

At the end of the polymerization, the mixture contains 20% of a polymer composed of 75% by weight of acrylonitrile and 25% by weight of sulphonated derivative.

One part by weight of said mixture is immediately mixed with 11 parts by weight of a mixture containing 28.12 parts by weight of acrylonitrile, 16.87 parts by weight of vinylidene chloride, 4 parts by weight of water and 51 parts by weight of DMF.

The resulting mixture is subjected to polymerization at 52° C. for 13 hours in the presence of 0.22 parts by weight of azobisisobutyronitrile catalyst and 0.1 parts by weight of zinc paratoluenesulphonate stabilizer. At the end of the polymerization, the mixture contains in all 19.5% of a polymer which is composed of 61% by weight of acrylonitrile, 36% by weight of vinylidene chloride and 3% by weight of sulphonated derivative, while the utilization rate of the sulphonated derivate is about 93%.

After distillation under a vacuum, to eliminate and recover the volatile unreacted monomers and to eliminate the water, a final solution is obtained which contains 22.5% of polymer and which is spun under the same conditions as in example No. 1.

The fiber thus obtained has the following control data:

a. see photo No. 2 (FIG. 2)
b=2.5 g of dye
c=26% of $O_2$
d:
filament count in dtex=3.2
tenacity in g/dtex=2.7
elongation %=33.5
loop tenacity in g/dtex=1.2

The control data of this example, compared to example no. 1, show a luster and dye yield which are slightly lower, however are still markedly higher than those of comparison example no. 4, while the utilization rate of the sulphonated monomer is still high, and significantly exceeds 90%.

EXAMPLE No. 3

In this example the control data are set forth of a fibre produced in the same way as in example no. 2, with the sole exception that the amount of vinylidene chloride has been increased from 36 to 45% so that the inflammability of the fiber obtained corresponds to a LOI index of 30%.

The binary copolymer is obtained by copolymerizing at 67° C. for 11 hours, 27.2 parts by weight of acrylonitrile and 4.8 parts by weight of sulphonated derivative, in 2 parts by weight of water and 66 parts by weight of DMF, in the presence of 0.027 parts by weight of azobisisobutyronitrile catalyst and 0.015 parts by weight of malic acid stabilizer. At the end of the polymerization, the mixture contains 21% by weight of a polymer composed of 85% of acrylonitrile and 15% by weight of 2-acrylamido-2-methylpropane-sodium sulphonate.

One part by weight of said end polymerization mixture is immediately mixed with 6.5 parts by weight of a mixture containing 21.60 parts by weight of vinylidene chloride, 4 parts by weight of water and 51 parts by weight of DMF. The resulting mixture is subjected to copolymerization at 52° C. for 13 hours in the presence of 0.2 parts by weight of azobisisobutyronitrile catalyst and 0.1 parts by weight of zinc paratoluenesulphonate stabilizer. At the end of the polymerization, the mixture contains 19.2% of a polymer which is composed of 52% by weight of acrylonitrile, 45% by weight of vinylidene chloride and 3% by weight of 2-acrylamido-2-methylpropane-sodium sulphonate, while the utilization rate of the sulphonated monomer increases to 9.5%.

The resulting mixture is subjected to distillation under a vacuum to eliminate and recover the volatile unreacted monomers and to eliminate the water and a solution containing 22.5% of solid matter is obtained, which is spun under the same condition as in the preceding examples.

The fiber produced has the following control data:

a: see photo No. 3 (FIG. 3)
b=3.0 g of dye
c=30% of $O_2$
d:
filament count in dtex=3.2
tenacity in g/dtex=2.0
elongation %=36
loop tenacity in g/dtex=1.0

It is seen from the control data the increase in the vinylidene chloride content only slightly lowers the luster and the dye yield of the fiber, which anyway are still markedly superior to those of comparison example No. 4, while the LOI index permits to consider the fibre as self-extinguishing.

EXAMPLE No. 4 (comparison example)

In this example, which does not illustrate the invention but serves for comparison, the control dat are set forth of a fiber obtained from a ternary copolymer having the same final composition as the copolymer of example No. 1, viz, 61% by weight of acrylonitrile, 36% by weight of vinylidene chloride and 3% by weight of 2-acrylamido-2-methylpropane-sodium sulphonate, which copolymer however has been produced not by the two-phase polymerization process which is an object of this invention, but by the classic and well known single-phase, ternary copolymerization process.

The ternary polymer is obtained by copolymerizing at 52° C. for 13 hours, 27.81 parts by weight of acrylonitrile, 16.20 parts by weight of vinylidene chloride and 0.99 parts by weight of 2-acrylamido-2-methylpropane-sodium sulphonate in 3 parts by weight of water and 52 parts by weight of DMF, in the presence of 0.22 parts by weight of azobisisobutyronitrile catalyst and 0.1 parts by weight of zinc paratoluenesulphonate stabilizer.

At the end of the polymerization, the solution contains 20.3% by weight of a polymer which is composed of 61% by weight of acrylonitrile, 36% by weight of vinylidene chloride and 3% by weight of sulphonated derivative, while the utilization rate of the sulphonate does not exceed 60%. The spinning solution containing 22.5% of said polymer, obtained after distilling off the unreacted monomers, is spun in the same way as in the preceding examples.

The fiber thus obtained has the following control data:

a: see photo No. 4 (FIG. 4)
b=5.6 g of dye
c=26% of $O_2$
d:
filament count in dtex=3.3
tenacity in g/dtex=2.4
elongation=31
loop tenacity in g/dtex=1.2

The control data relative to this example evidence a much more opaque or lusterless fiber and much lower dye yields than those of the preceding examples, while the utilization rate of the sulphonated monomer is much lower (60%).

The following examples illustrate the use of significantly homopolymerizable sulphonic monomers, of the class hereinbefore defined, other than 2-acrylamido-2-methyl-propane-sodium sulphonate.

EXAMPLE No. 5

The operations of example No. 1 are repeated using 2-acrylamido-2-propanesulphonic acid as the sulphonic monomer.

The binary acrylonitrile/sulphonic monomer copolymer is produced by using 27.9 parts by weight of acrylonitrile and 4.1 parts by weight of the sulphonic monomer, all other components, quantities and conditions being the same as in example No. 1. At the end of the first copolymerization phase, the copolymer contains 87% by weight of acrylonitrile and 13% by weight of 2-acrylamido-propane-sulphonic acid.

The second copolymerization phase is carried out as in example No. 1, and at the end thereof, the mixture contains 61.5% by weight of acrylonitrile, 36% by weight of vinylidene chloride, and 2.5% by weight of the sulphonic monomer.

EXAMPLE No. 6

The operations of example No. 1 are repeated using 2-acrylamido-phenylethanesulphonic acid as the sulphonic monomer.

The binary acrylonitrile/sulphonic monomer copolymer is produced by using 27.0 parts by weight of acrylonitrile and 5.0 parts by weight of the sulphonic monomer, all other components, quantities and conditions being the same as in example No. 1. At the end of the first copolymerization phase, the copolymer contains 83.3% by weight of acrylonitrile and 16.7% by weight of 2-acrylamido-phenyl-ethane-sulphonic acid.

The second copolymerization phase is carried out as in example No. 1, and at the end thereof, the mixture contains 60.7% by weight of acrylonitrile, 36% by weight of vinylidene chloride, and 3.3% by weight of the sulphonic monomer.

The control data both of example No. 5 and of example No. 6 do not significantly differ from those of example No. 1.

A number of illustrative embodiments of the invention have been described, but it is clear that it can be carried into practice by a person skilled in the art with many variations and modifications.

We claim:

1. Process for the preparation of spinnable solutions of copolymers containing 50–85% by weight of acrylonitrile, 13.5–46.5% by weight of vinylidene chloride and 1.5–3.5% by weight of at least one significantly homopolymerizable comonomer which contains at least one sulphonic group, useful for the manufacture of modacrylic fibers having low inflammability and high luster, which process comprises the steps of copolymerizing, in a first copolymerization phase, acrylonitrile with said significantly homopolymerizable sulphonic comonomer, in an organic solvent miscible with water, in the presence of a catalyst, mixing the product derived from said first copolymerization phase with a solution of acrylonitrile and vinylidene chloride in the same solvent, and effecting a second copolymerization phase, the composition of the solutions being such that the final product has a water content below 4% by weight.

2. Process according to claim 1, wherein the solvent is dimethylformamide.

3. Process according to claim 1, wherein the significantly homopolymerizable sulphonic comonomer is a derivative of an acid having the general formula

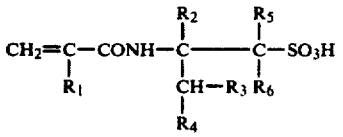

wherein $R_1$ is hydrogen or a lower alkyl radical, and $R_2$, $R_3$, $R_4$, $R_5$, $R_6$, equal to or different from one another, are each hydrogen or an alkyl, cycloalkyl or aryl radical.

4. Process according to claim 3, wherein the sulphonic comonomer is selected from the group consisting of 2-acrylamido-2-methylpropane-sodium sulphonate, 2-acrylamido-2-propanesulphonic acid, and 2-acrylamido-2-phenylethanesulphonic acid.

5. Process according to claim 1, wherein the product of the second copolymerization phase is subjected to distillation to eliminate the unreacted monomers and concurrently the water which is present in the copolymerization phases.

6. Process according to claim 1, wherein the solution which is subjected to the first copolymerization phase comprises an overall percentage of comonomers which is between 25% and 35% by weight of the total and the sulphonic comonomer constitutes between 8% and 30% of the total of the two comonomers; the solution of acrylonitrile and vinylidene chloride contains an overall percentage of the two comonomers which is between 40% and 50% by weight and the acrylonitrile constitutes between 35% and 85% by weight of the total of the two comonomers, and the product of the first copolymerization phase is mixed in an amount of 5–40 parts by weight with 60–95 parts by weight of the second solution which contains the two monomers acrylonitrile and vinylidene chloride.

7. Process according to claim 1, wherein the catalyst is an azo derivative, the first copolymerization phase is effected at 50°–70° C. for 8–12 hours and the second copolymerization phase is effected at 40°–60° C. for 10–15 hours.

8. Process for the preparation of modacrylic fibers having low inflammability and high luster, comprising the steps of preparing a spinnable solution according to claim 1, distilling the unreacted monomers and the water, and spinning the resulting viscous solution in a bath essentially consisting of a mixture of water and spinning solvent.

9. Compositions for the preparation of modacrylic fibers having reduced inflammability and high luster produced by the process according to claim 1.

* * * * *